United States Patent [19]

Hall

[11] Patent Number: 4,712,794

[45] Date of Patent: Dec. 15, 1987

[54] JOGGERS FLUID WEIGHTED EXERCISER JUG

[76] Inventor: Gary W. Hall, 7316 Carver Rd., Modesto, Calif. 95356

[21] Appl. No.: 916,014

[22] Filed: Oct. 6, 1986

[51] Int. Cl.[4] ..... A63B 11/00

[52] U.S. Cl. ..... 272/122; 222/521

[58] Field of Search ..... 272/122, 173, 521

[56] References Cited

U.S. PATENT DOCUMENTS

| | | | |
|---|---|---|---|
| Re. 23,612 | 1/1953 | Abel | 446/166 |
| D. 276,890 | 12/1984 | Hancher | D9/376 |
| 1,019,584 | 0/1912 | Balston | 272/122 |
| 3,334,899 | 8/1967 | Bosko et al. | 272/122 |
| 4,079,932 | 3/1978 | Schuetz | 272/75 |
| 4,199,140 | 4/1980 | Ferretti | 272/123 |
| 4,477,002 | 10/1984 | Stull | 222/521 |

*Primary Examiner*—Richard J. Scanlan, Jr.

*Attorney, Agent, or Firm*—A. Robert Theibault

[57] ABSTRACT

The present disclosure is directed to a joggers fluid weighted exercising jug having a handle and fluid weight chambers to each side or end thereof and a dispensing connection actuatable by the teeth of the jogger to partake of a nutritional liquid from within the jug without having to stop jogging. The overall geometric configuration of the jug generally resembles a dumbbell.

1 Claim, 7 Drawing Figures

JOGGERS FLUID WEIGHTED EXERCISER JUG

TECHNICAL FIELD

The present invention is directed to a joggers fluid weighted exercising jug which has a handle for gripping by the jogger and is weighted with a potable liquid to be consumed by a walker, hiker or jogger while engaged in their efforts or exertions and which starts out with maximum weight as the exercise begins and which by consumption lightens as fatigue sets in. The jug being somewhat like a dumbbell weight is filled with a nutritional liquid and increases body balance, provides increased resistance, upper body conditioning and would be protective of the individuals hands in case of a slip or fall.

BACKGROUND ART

Numerous weighted fluid containing exerciser devices containing fluid for weighting have been known such as U.S. Pat. Nos. 1,019,584, Re 23,612, 3,334,899, 4,079,932, and Des. 276,890. However none of these embody my claimed configuation nor do they suggest that the weighting fluid be a nutritional potable fluid to be consumed by the exerciser during the exercise. These patents are the most relevant art known to me at the time of filing this application.

SUMMARY OF THE INVENTION

The present invention is directed to a dumbbell-like container device to be carried by joggers during the pursuit of their exercise which device may be filled with a nutritional liquid which is potable and may be consumed by the exerciser during his or her jog not requiring stopping to satisfy thirst in a location where drinkable liquids may not be available. Content markings may be placed on container to advise the user of the amount of liquid available for consumption.

The container device is made of plastic of the injection molded type quality and has a handle for grasping, a twist off cap wide enough through which to insert a tablespoon and the cap may have a pop up tip on its top which can be actuated by the joggers teeth when it is desired to partake of the nutritional contents of the container.

The geometric configuration of the container device increases body balance, provides increased resistance, upper body conditioning and would be protective of the joggers hands in case of a slip or fall along the jogging route.

BRIEF DESCRIPTION OF THE FIGURES OF DRAWING

BEST EMODIMENT FOR PRACTICING THE INVENTION

Figure 1:
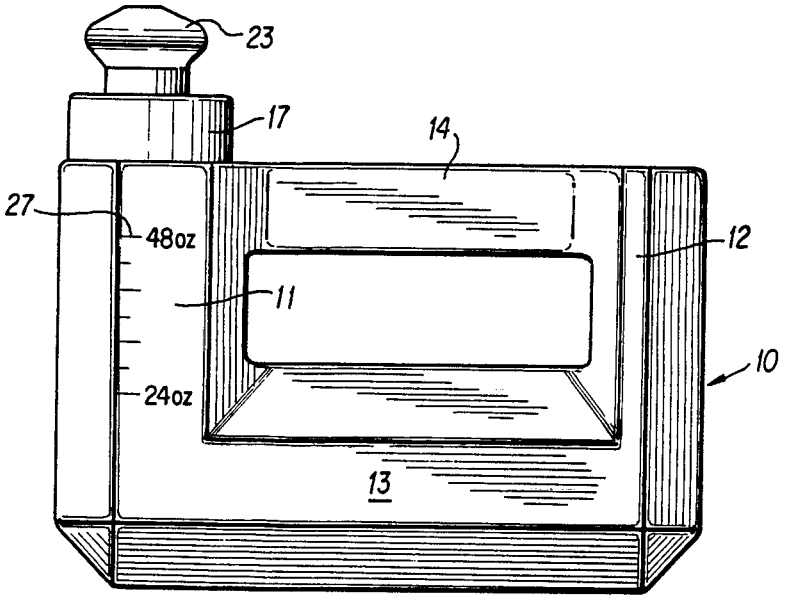
FIG. 1 is a side elevational view of the joggers fluid weighted exerciser jug constructed in accordance with my invention.
Figure 2:
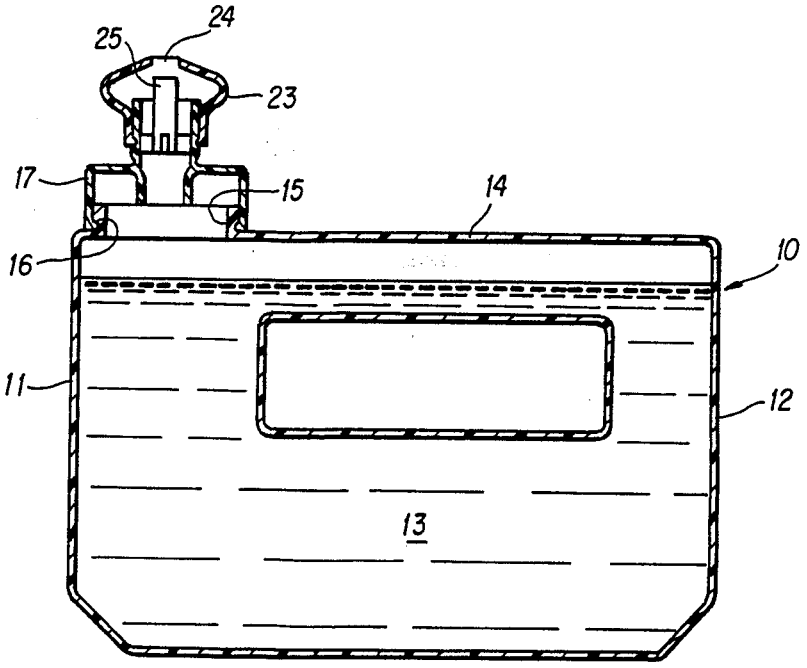
FIG. 2 is a vertical longitudinal section taken through the jug of FIG. 1.
Figure 3:
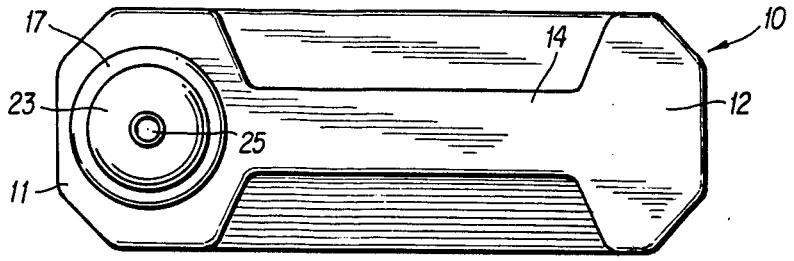
FIG. 3 is a top plan view of the jug of FIG. 1.

Referring now to the drawings and for the moment to FIGS. 1 through 3, 10 designates generally the joggers fluid weighted exercising jug having a front and rear liquid riser 11 and 12 joined by a bottom connector reservoir 13 and a top hollow handle 14 connecting the front and rear risers 11 and 12 at their upper ends. The jugs 10 come in pairs to symmetrically balance the joggers upper body as shown in FIG. 7.

Located at the top of liquid riser 11 is a cap rim 15 having an under cut annular lip 16 which extends circumferentially about the cap rim 15 for snap fit with a primary dispensing cap 17 which also has an annular projection rim 17A circumferentially about the primary cap 17 to seat and lock behind the circumferential lip 16.

Figure 4:
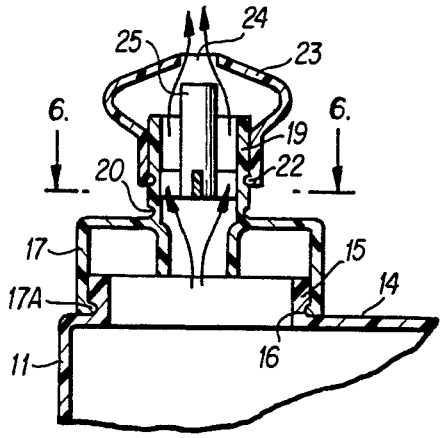
FIG. 4 is a fragmentary vertical sectional view taken at an enlarged scale through the liquid dispensing cap at the left hand end of FIG. 3 in the dispensing position.
Figure 5:
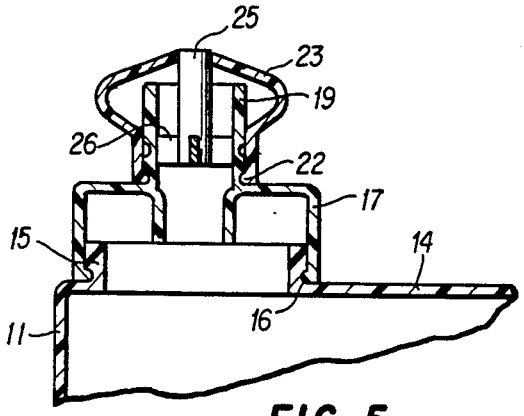
FIG. 5 is a view similar to FIG. 4 with the dispensing cap located in the down non-dispensing position.
Figure 6:
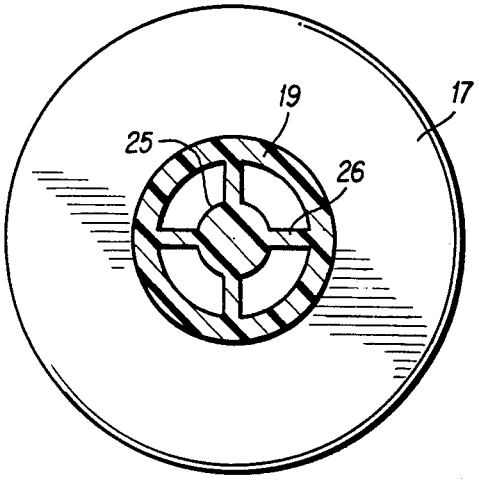
FIG. 6 is a horizontal cross-sectional view taken on the lines 6—6 in FIG. 4.

Referring now to FIG. 4 the upper portion of the cap 17 has an annular upper extension 19 having two under cut annular recesses 20, 21 which receive an annular lip 22 about a liquid dispensing cap 23 and which lock it either in the upper dispensing position or the down non-dispensing jog position. The dispensing cap 23 has a dispensing opening 24 which when the cap 23 is in the down position of FIG. 5 is plugged by a dowel 25 carried by a spider support 26 which seats in the extension 19 and as shown by the flow line arrows permits the nutritional liquid to pass from the reservoir 13, through the opening 24 in cap 23 into the mouth of the jogger while he or she is jogging. The cap can be unseated from the position of FIG. 5 to the drinking condition of FIG. 4 by the jogger merely grasping it between his or her teeth.

Figure 7:
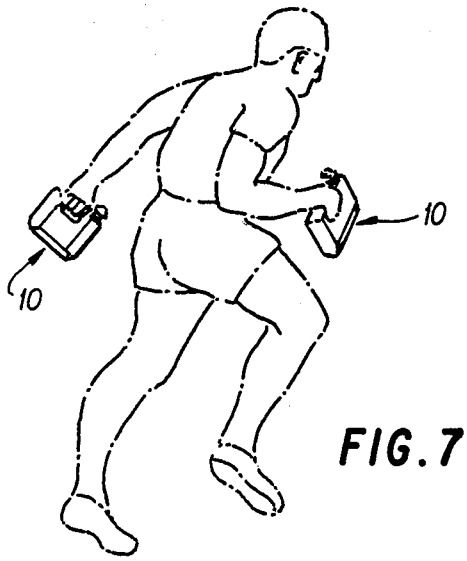
FIG. 7 is a schematic of a jogger jogging with the exerciser jug of FIG. 1.

The jogger as best seen in FIG. 7 has only to raise the jug to his mouth, engage his teeth about the cap 23 and pull it up or seat it to block the opening 24 in the cap 24.

The joggers fluid weighted exerciser jug 10 is designed along the lines of a dumbbell weight which is filled with water, fortified drink or other potable liquid to be consumed by walkers, hikers and joggers during their exertions. The device satisfies satiation on demand. The device also increases body balance as shown in FIG. 7, providing increased resistance, upper body conditioning and affords protection for the hands in case of a slip or fall. The primary purpose is of a nutritional factor. All parts are made of plastic of the injected mold type such as polyvinyl chloride or polyethylene. The jug 10 volume may hold between thirty-two and forty-eight ounces of liquid. The clear plastic jug 10 may be provided with graduated lines indicating volume and weight as shown at 27 in FIG. 1 which will constantly be available for visual inspection of the jogger while on the run.

What I claim is:

1. A joggers fluid weighted exerciser jug comprising a base liquid reservoir, front and rear liquid risers upstanding from and in fluid connection with said reservoir, a hollow handle connecting said front and rear liquid risers at their tops, primary cap means carried by one of said liquid risers upstanding from said hollow handle substantially normal thereto and having an upper and lower annular groove, a fluid dispensing cap having a dispensing opening and being carried by said primary cap means, spider means comprising a solid dowel upstanding therefrom carried by said primary cap means and positioned for said solid dowel to seal the dispensing opening in said fluid dispensing cap when said dispensing cap is in the down sealed position, and cap retaining means between said primary cap and said dispensing cap for locking said caps relative to one another between a sealed and dispensing condition along the axis of said dowel, said retaining means comprising an annular lip about the periphery of said dispensing cap resiliently movable between upper and lower annular grooves on said primary cap to open and close said fluid dispensing cap, said dispensing cap being shaped to fit within the mouth and behind the teeth of a user whereby said dispensing cap may be axially displaced to open and close said jug for removal of contents while jogging.

* * * * *